US005702227A

United States Patent [19]

Berg

[11] Patent Number: 5,702,227

[45] Date of Patent: Dec. 30, 1997

[54] EJECTOR BUCKET

[76] Inventor: Ronald Berg, R.R. 1, Box 190-A, Pelican Rapids, Minn. 56572

[21] Appl. No.: 645,102

[22] Filed: May 13, 1996

[51] Int. Cl.[6] ..... E02F 3/70

[52] U.S. Cl. ..... 414/704; 414/725; 37/901; 37/431

[58] Field of Search ..... 414/704, 725; 37/901, 903, 419, 426, 431

[56] References Cited

U.S. PATENT DOCUMENTS

| | | | |
|---|---|---|---|
| 2,806,617 | 9/1957 | Beyerstedt et al. | 414/704 |
| 3,035,724 | 5/1962 | Clark et al. | 414/704 |
| 3,176,863 | 4/1965 | Kuhl | 37/901 |
| 3,419,170 | 12/1968 | Salna et al. | 414/704 |
| 3,421,236 | 1/1969 | Moyer | 37/117.5 |
| 3,426,928 | 2/1969 | Campbell . | |
| 3,433,377 | 3/1969 | Campbell . | |
| 3,438,526 | 4/1969 | Baker . | |
| 3,451,151 | 6/1969 | Guinot | 37/187 |
| 3,452,458 | 7/1969 | Campbell | 37/8 |
| 3,452,462 | 7/1969 | Martin | 37/126 |
| 3,462,859 | 8/1969 | Hawk | 37/126 |
| 3,484,010 | 12/1969 | Campbell . | |
| 3,495,728 | 2/1970 | Long . | |
| 3,523,621 | 8/1970 | Anderson et al. . | |
| 3,539,069 | 11/1970 | Allen et al. . | |
| 3,543,960 | 12/1970 | Wagner . | |
| 3,581,924 | 6/1971 | Marz | 414/704 |
| 3,642,160 | 2/1972 | Rockwell et al. . | |
| 3,750,816 | 8/1973 | Becker . | |
| 3,777,915 | 12/1973 | Reed . | |
| 3,837,516 | 9/1974 | Meyer . | |
| 3,872,986 | 3/1975 | Campbell . | |
| 3,916,545 | 11/1975 | Hochmann et al. | 37/126 AB |
| 3,937,345 | 2/1976 | Countryman . | |
| 3,977,102 | 8/1976 | Ohms | 37/8 |
| 4,032,015 | 6/1977 | Hemphill . | |
| 4,144,980 | 3/1979 | Meyer | 414/725 |
| 4,308,677 | 1/1982 | Behm | 37/126 AE |
| 4,349,308 | 9/1982 | Buckstead et al. | 414/725 |
| 4,366,635 | 1/1983 | Joyce, Jr. | 37/8 |
| 4,925,359 | 5/1990 | Dunnegan | 414/722 |
| 5,241,764 | 9/1993 | Modig | 37/405 |
| 5,476,356 | 12/1995 | Weiss | 414/704 |

OTHER PUBLICATIONS

Sanderson Attachments, Sanderson Group Marketing, Croft, Skegness, Lincolnshire, England PE24 4RW, pp. 1–12.

Caterpillar Inc., Attachments for Cat Backhoe Loaders product catalog.

*Primary Examiner*—Karen B. Merritt
*Assistant Examiner*—Gregory A. Morse
*Attorney, Agent, or Firm*—Merchant, Gould, Smith, Edell, Welter & Schmidt, P.A.

[57] ABSTRACT

An ejector bucket includes a bucket frame, an ejector plate, and two actuating cylinders. The bucket frame has opposing side walls and a bottom wall extending between the side walls. The ejector plate is located within the bucket frame, and is movable between a load position where the ejector plate and the bucket frame together form a bucket for holding material and an eject position where the ejector plate has pushed substantially all of the material out of the bucket. The two hydraulic actuating cylinders are connected to the bucket frame and to the ejector plate. Each of the actuating cylinders is located adjacent to one of the side walls of the bucket frame. The actuating cylinder is operable in a push mode where an actuating rod is pushed out of the cylinder casing, and is operable in a pull mode where the actuating rod is drawn into the casing. Operation of the ejector cylinder in the pull mode causes the ejector plate to eject material from the bucket, while operation of the ejector cylinder in the push mode causes the ejector plate to move back to the load position.

10 Claims, 5 Drawing Sheets

EJECTOR BUCKET

The present invention relates to an ejector bucket the type used with skid-steer loaders and other related machines to pick up dirt, gravel and other material. The ejector bucket has a movable ejector plate which functions to push the material out of the bucket without the need to tip the bucket downward.

BACKGROUND OF THE INVENTION

Ejector buckets are an attachment commonly used with machines such as skid-steer and other front end loaders. What generally distinguishes an ejector bucket from a standard bucket is the presence of an ejector plate within the bucket which is movable so as to empty the contents of the bucket without the need to tip the bucket downward.

A typical ejector bucket is shown in U.S. Pat. No. 4,144,980, issued Mar. 20, 1979 to Meyer. Such an ejector bucket generally includes a bucket frame made up of a bottom wall and two opposing side walls. The ejector plate is generally located within the bucket frame, and is hingedly connected to the side walls of the bucket frame at the top edge thereof. A single, centrally-located hydraulic actuating cylinder is typically attached to the bucket frame and to the ejector plate. Actuation of the cylinder causes the ejector plate to move between a load position and an eject position. In the load position, the bucket frame and the ejector plate together form a bucket for holding material. In the eject position, the ejector plate has moved forward so as to push the material out of the bucket. The actuating cylinder is mounted such that it moves the ejector plate from the load to the eject position while operating in the "push" mode, i.e., when the actuating rod of the cylinder is pushed out of the cylinder casing.

Such an ejector bucket suffers from a number of disadvantages. The distribution of force which can be applied to the ejector plate by a single, centrally-mounted cylinder is limited. The ejector plate will have a tendency to bend at the outer edges when pushed by a centrally-located cylinder. Also, the weight of material which can be placed in the loader generally increases the closer that the bucket load is mounted to the loader. The presence of a single, centrally-mounted cylinder makes it more difficult to mount the bucket load close to the loader.

There are also disadvantages to having the ejector bucket eject material while the cylinder operates in the push mode. Application of a large load to the actuating rod of the cylinder in the push mode can cause compression failure of the rod, thereby requiring a larger diameter rod. Moreover, hydraulic cylinders generally operate faster in the pull mode. Thus, an ejector bucket like that shown in Meyer operates slower when ejecting material than when returning to the load position. This quick return stroke can cause material which gets behind the ejector plate to be blown back toward the operator.

In the ejector bucket shown in the Meyer patent, the ejector plate is pivotably attached to the very top of the bucket frame side walls. As a result, there is a danger that if the ejector plate is accidentally actuated while the bucket is raised up and tipped back, the material will spill over the back of the bucket and potentially land on the operator.

Also, in the ejector bucket shown in the Meyer patent, the actuating cylinder rotates backwards and forwards together with the ejector plate as it is moved. Such movement of the actuating cylinder can cause wear to the cylinder mounting brackets, as well as the hoses and hose fittings connected to the cylinder.

SUMMARY OF THE INVENTION

The invention includes an ejector bucket for loading and ejecting material. The ejector bucket has a bucket frame, the bucket frame including opposing side walls and a bottom wall extending between the side walls. An ejector plate is located within the bucket frame. The ejector plate is movable between a first position where the ejector plate and the bucket frame together form a bucket for holding material and a second position where the ejector plate has pushed substantially all of the material out of the bucket. A hydraulic actuating cylinder is connected to the bucket frame and the ejector plate. The cylinder includes a casing having a cylindrical side wall and opposing end walls, a piston movably disposed within the casing, and a rod having a first end attached to the piston and a second end extending out of the casing through an opening in one of the end walls. The actuating cylinder is operable in a push mode where the piston moves so as to push the rod out of the casing, and is operable in a pull mode where the piston moves so as to draw the rod into the casing. Operation of the actuating cylinder in the pull mode causes the ejector plate to move from the first position to the second position, and operation of the actuating cylinder in the push mode causes the ejector plate to move from the second position in or slowly to the first position.

The invention also includes an ejector bucket, having a bucket frame, and ejector plate, and two actuating cylinders. The bucket frame includes opposing side walls and a bottom wall extending between the side walls. The ejector plate is located within the bucket frame, and is movable between a first position where the ejector plate and the bucket frame together form a bucket for holding material and a second position where the ejector plate has pushed substantially all of the material out of the bucket. The two hydraulic actuating cylinders are connected to the bucket frame and to the ejector plate. Each of the cylinders is located adjacent to one of the side walls of the bucket frame. Each of the cylinders includes a casing having a cylindrical side wall and opposing end walls, a piston movably disposed within the casing, and a rod having a first end attached to the piston and a second end extending out of the casing through an opening in one of the end walls. The actuating cylinders are operable so as to move the ejector plate between the first position and the second position.

Preferably, the ejector plate includes first and second plate members and a hinge which joins the first and second plate members together. Two ejector brackets are preferably connected to the first plate member. The ejector brackets are connected to the bucket frame so as to be pivotal about a pivot axis. Each ejector bracket has a lever arm extending at an angle from the first plate member. One of the actuating cylinders is preferably attached to the end of each lever arm. Thus, actuation of the cylinders causes the ejector brackets to rotate around the pivot axis, which in turn causes the ejector plate to move between the first and second positions.

The ejector brackets are preferably connected to the side walls of the bucket frame at a point below the top surface thereof. An overflow guard may extend between the side walls in the area of the top surface, to prevent unwanted spillback of material from the bucket.

DETAILED DESCRIPTION OF THE PREFERRED EMBODIMENT

Figure 1:
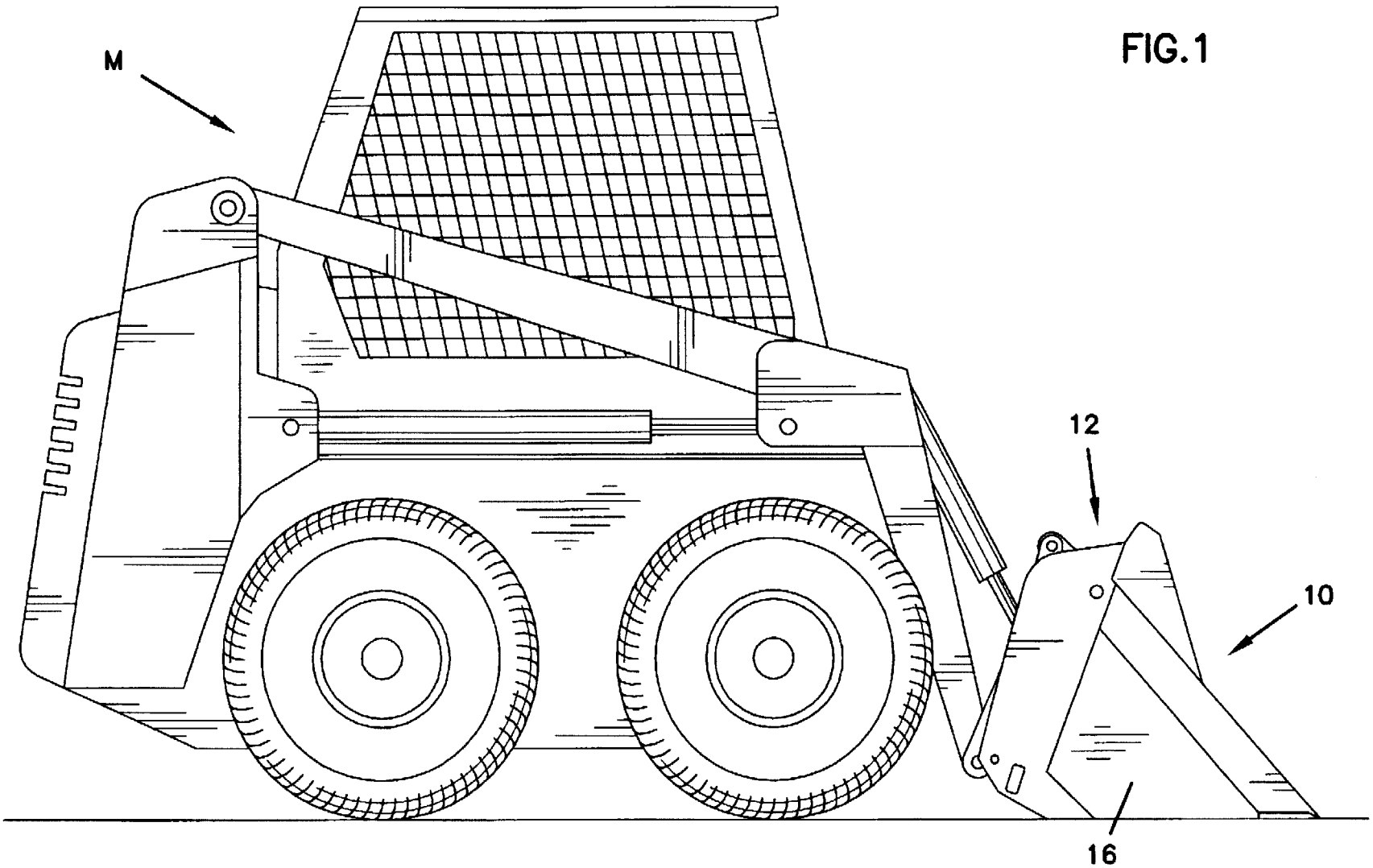
FIG. 1 is a side view of a skid-steer front loader attached to an ejector bucket made according to a preferred embodiment of the present invention.
Figure 2:
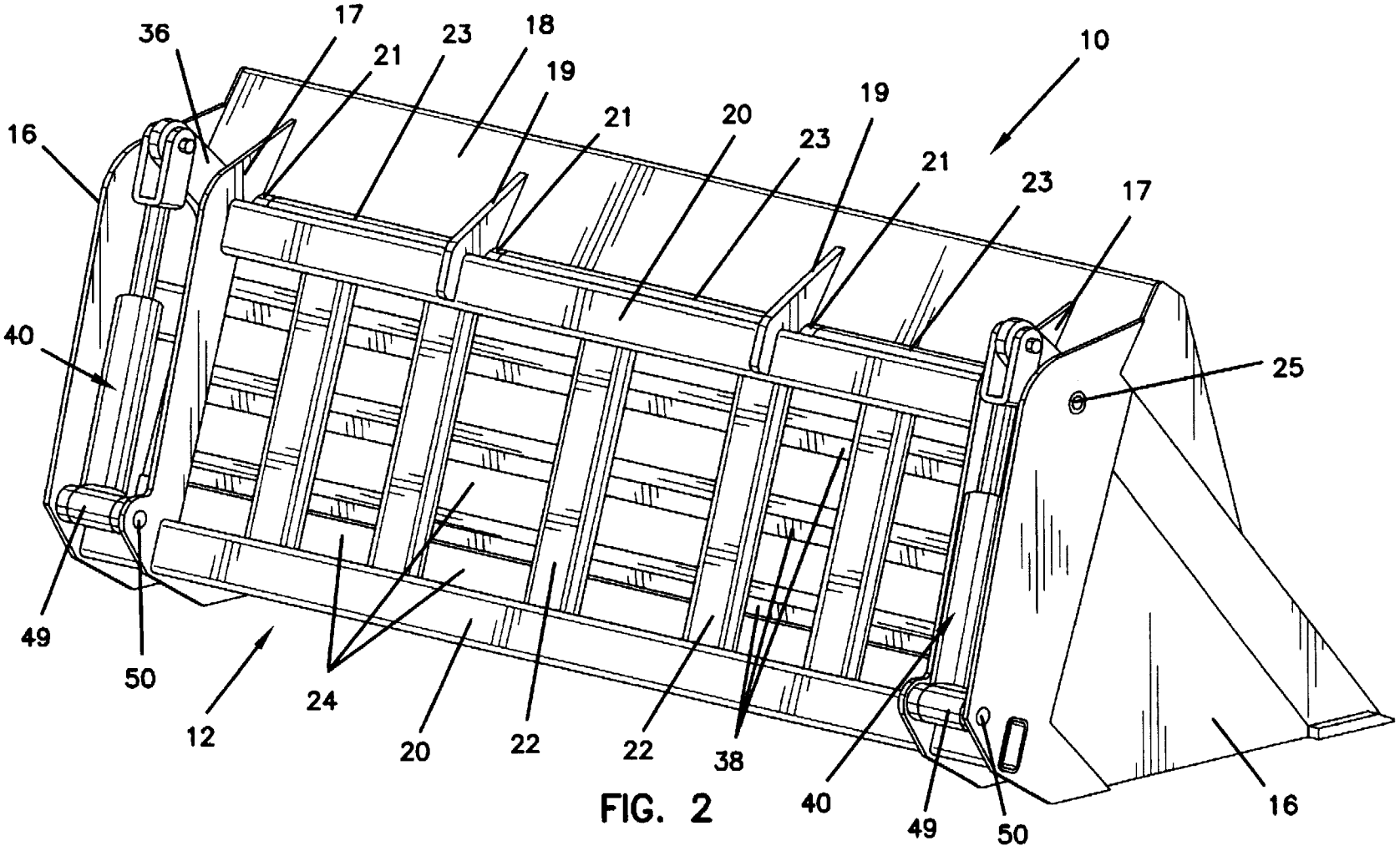
FIG. 2 is a perspective view of an ejector bucket made according to a preferred embodiment of the present invention.
Figure 3:
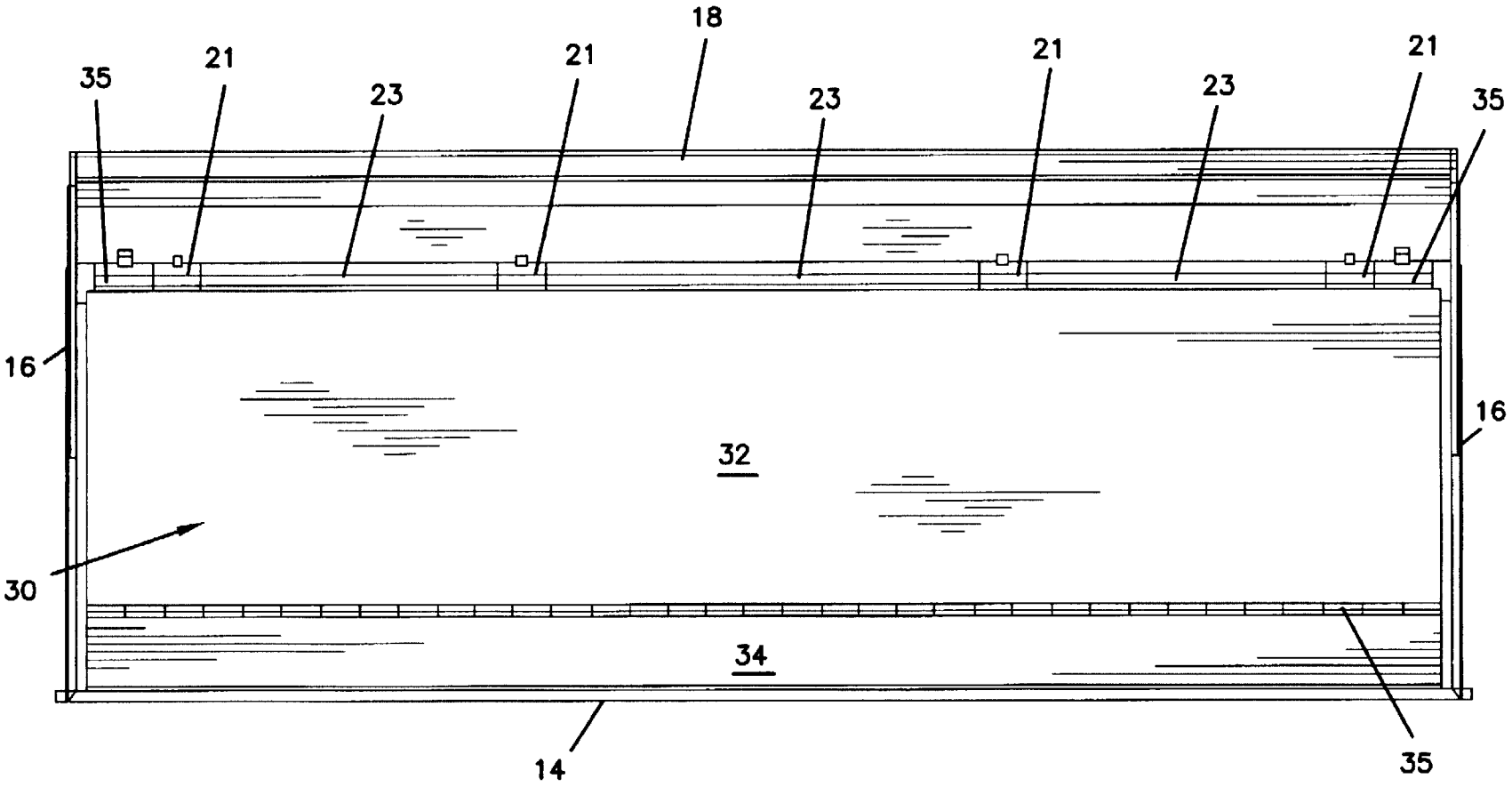
FIG. 3 is a front view of the ejector bucket shown in FIG. 2.
Figure 4:
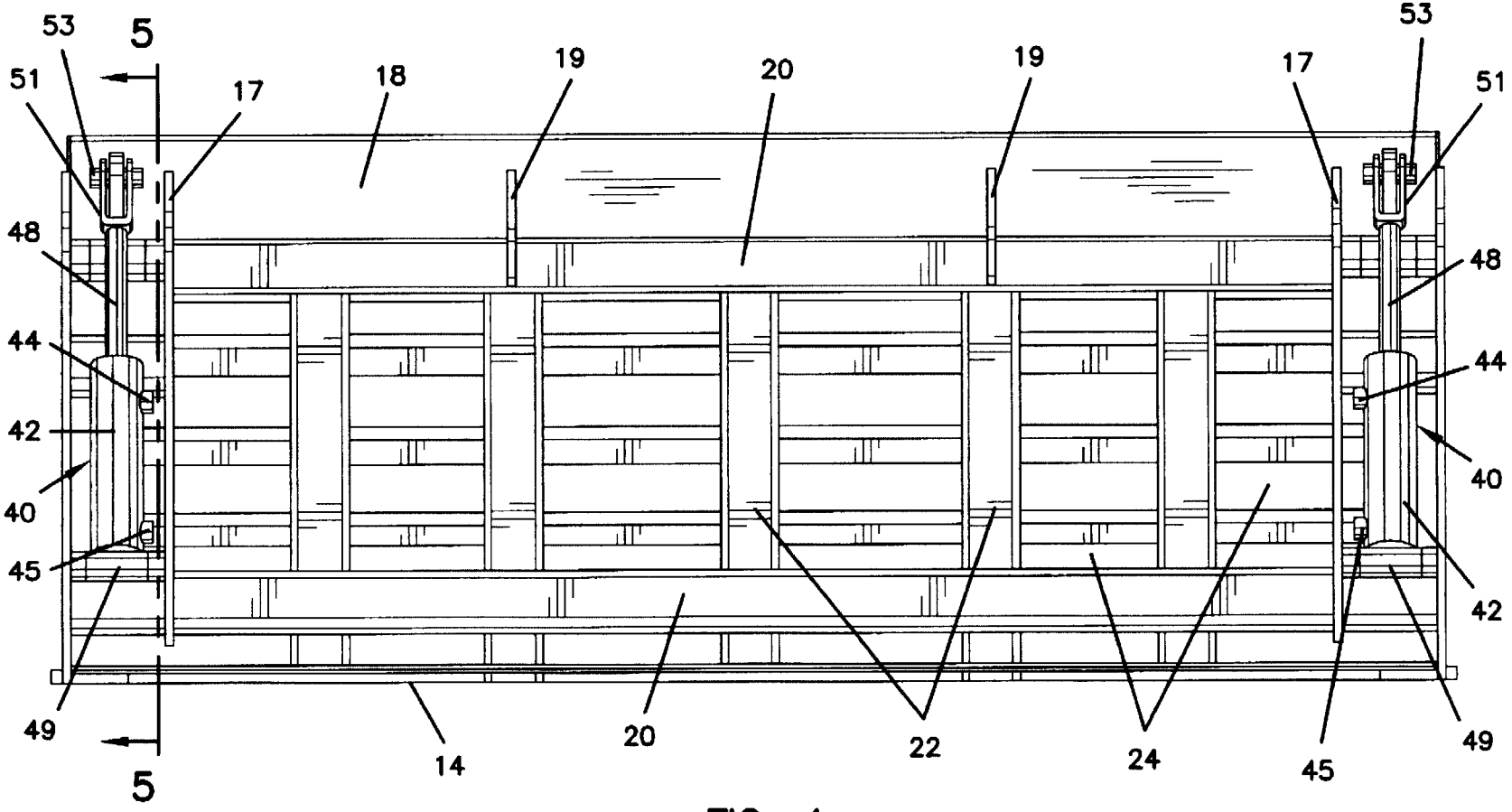
FIG. 4 is a rear view of the ejector bucket shown in FIG. 2.

An ejector bucket 10 made according to the preferred embodiment is shown in FIG. 1 attached to a loader machine M. The machine M shown in FIG. 1 is a skid-steer front loader of the type commonly sold under the trademark Bobcat, although the ejector bucket of the present invention may be applied to a wide variety of front loaders, backhoe loaders, or other related machines.

The ejector bucket includes a bucket frame 12. The bucket frame has a bottom wall 14 and two opposing side walls 16. An overflow guard 18 preferably extends between the side walls along the upper back portion thereof. Also extending across the back of the bucket frame are a plurality of vertical and horizontal strengthening bars 20 and 22. These strengthening bars provide structural stability and strength to the bucket frame, and also a surface to which loader coupling plates can be mounted. The strengthening bars preferably define openings 24 (not shown) therebetween, which allow any material which gets behind the ejector plate to be pushed out through the back of the bucket frame.

The frame also includes inner plate members 17 which are spaced a short distance from each on the side walls 16. The inner plate members and side walls define spaces between them which contain ejector brackets 36 and actuating cylinder 40. The frame also includes center support brackets 19 attached to a strengthening bar 20 and to overflow guard 18. These center support brackets provide further structural stability to the ejector bucket.

An ejector plate 30 is disposed within the bucket frame. The ejector plate is preferably made up of plate members 32 and 34 which are connected together by a hinge 35. The ejector plate is pivotably connected to the frame, preferably through a hinge structure. The preferred hinge structure includes hinge collars 21 attached to each of the inner plate members and center support brackets 19, and hinge tubes 23 attached to the top of plate member 32. Pivot bars 25 are inserted through the hinge collars and the hinge tubes. In the preferred embodiment, two pivot bars 25 are employed, each being inserted through an opening in one of the frame side walls and extending approximately half way across the ejector bucket; alternatively, a single pivot bar extending all of the way across may be used.

As noted above, ejector brackets 36 are preferably located in the spaces between the side walls 16 and the inner plate members 17. Each of the ejector brackets has a collar 35 so as to be pivotably mounted on the pivot bar 25. Each ejector bracket further has a mounting arm 37 and a lever arm 39 which extends at an angle relative to the mounting arm. The mounting arms extends along and are attached to the back side of plate member 32. A plurality of strengthening ribs 38 extend across the back of plate member 32 and are attached to the mounting arms. A strengthening rib 41 may also extend across the back of plate member 34.

The ejector bucket of the preferred embodiment includes two actuating cylinders 40. The actuating cylinders are of a type generally known in the art and used in connection with loading equipment. The actuating cylinder may include a casing 42 having a cylindrical side wall and two generally flat end walls. Fittings 44, 45 are formed in the casing and are connected to hoses (not shown) which supply hydraulic fluid to the interior of the casing. Within the casing is a piston (not shown) which is movable in response to changes in pressure of the hydraulic fluid supply. An actuating rod 48 is attached to the piston and extends out of an opening in one end of the casing.

Each of the actuating cylinders is attached to the bucket frame and to one of the ejector brackets. Preferably, the casing 42 has a mounting collar 49 which is pivotably attached to a pivot pin 50 extending between side wall 16 and inner plate member 17. The end of the actuating rod may have a U-shaped bracket 51 which fits around the end of lever arm 39 of the ejector bracket. A pin 53 extends through openings located in both the bracket 51 and the lever arm 39 so as to connect the actuating rod to the lever arm.

Figure 5:
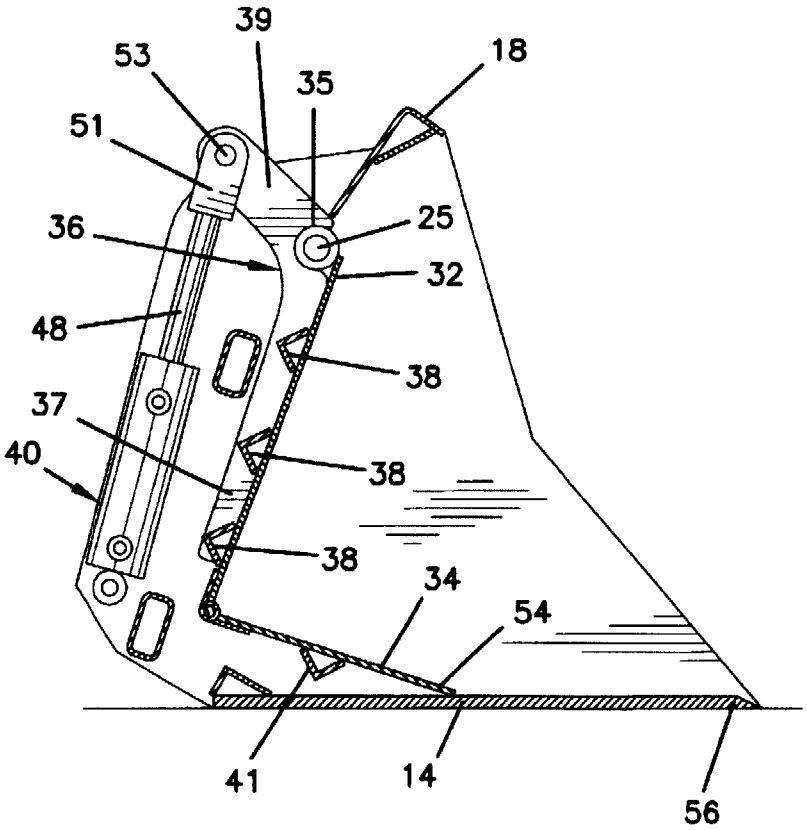
FIG. 5 is a cross-sectional view taken along lines 5–5 in FIG. 4, showing the ejector plate in the load position.

Actuation of the actuating cylinders causes the ejector plate to rotate about the pivot rod 25, which in turn causes the ejector plate to move between a load position and an eject position. The load position is shown in FIG. 5. In the load position, the ejector plate 30 is drawn toward the back of the bucket frame, and the plate members 32, 34 form an angle of roughly 90° relative to each other. In this position, the ejector plate and the bucket frame together form a bucket space to receive material. In the load position, the actuating rod is at its extended position out of the cylinder casing.

Figure 6:
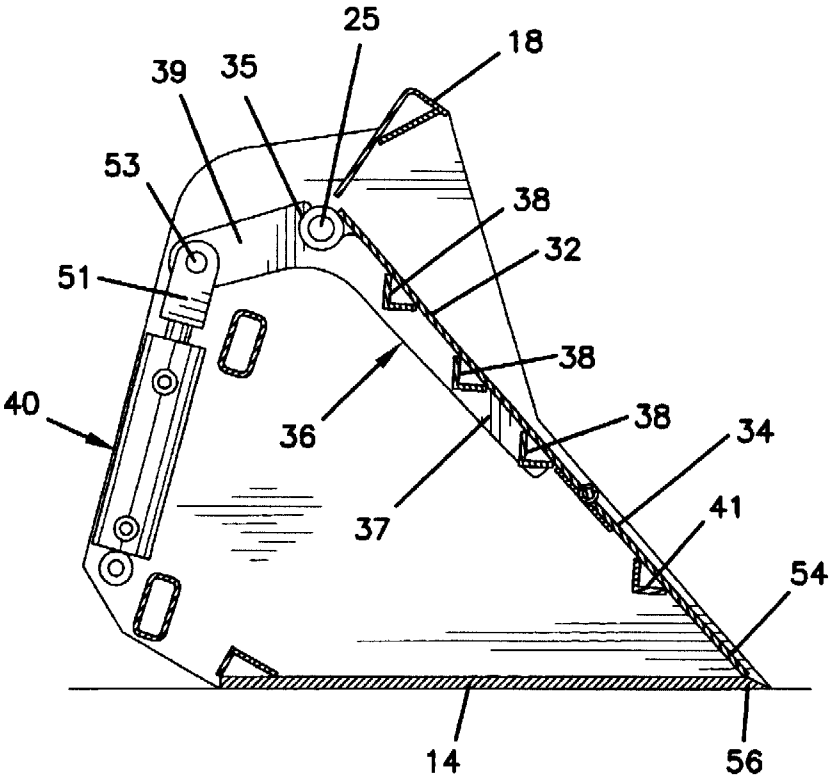
FIG. 6 is a cross-sectional view similar to FIG. 5, but showing the ejector plate in the eject position.

Actuation of the cylinders so as to draw the actuating rods into the casings causes the ejector plate to move from the load position to the eject position, shown in FIG. 6. In the eject position, the leading edge 54 of plate member 34 preferably moves forward so that it coincides generally with the leading edge 56 of the bucket frame. Also, in the eject position, the plate members 32, 34 are preferably generally parallel to each other, and coincide generally in position with the forward edge of side walls 16. Thus, movement of the ejector plate from the load position to the eject position causes substantially all of the material in the bucket space to be pushed out of the ejector bucket.

In moving from the load position to the eject position, the leading edge 54 of plate member 34 is pressed against the bottom wall 14 of the bucket frame. Moreover the side edges of the ejector plate members fit closely against the side walls 16 of the ejector frame. Thus, very little material in the bucket space can get behind the ejector plate. Any small amount of material which gets behind the ejector plate can be pushed out of the openings 24 formed in the back of the bucket frame when the ejector plate is returned to the load position.

As can be seen from the drawings, the pivot bar 25 is preferably not mounted at the top of side walls 16, but rather is mounted part way down the side walls, for example in the region of the base of overflow guard 18. This configuration helps prevent material from being ejected backwards toward the operator if the ejector plate is accidentally actuated while the bucket frame is lifted up and tilted back. At the same time, this configuration does not prevent all the material from being properly ejected from the front of the ejector bucket.

It should be noted that, according to the preferred embodiment of the invention, ejection of material from the bucket takes place while the actuating cylinders are operating in the pull mode, i.e., as the actuating rod is drawn into the casing. This is advantageous for several reasons. One, a hydraulic cylinder generally operates faster in the pull mode than in the push mode, because the hydraulic fluid is acting against a smaller end surface of the casing in the pull mode than in the push mode. Thus, the ejector plate of the preferred embodiment moves quicker when ejecting material than when moving back to the load position. The quicker ejection stroke helps unload the material quicker, and the slower return stroke helps minimize the unwanted "blow-back" of material behind the ejection plate at the operator of the machinery.

Another advantage of operating the cylinders in the pull mode during ejection of material is that it puts less stress on the actuating cylinders. The load applied to the actuating rod of a hydraulic cylinder is tensile in the pull mode, and thus can be much higher than the compression load applied to the actuating rod in the push mode. In an ejector bucket, the cylinder(s) face a much higher load when the ejector plate is ejecting material than when it is returning to the load position. Thus, by having the actuating cylinders of the preferred embodiment act to eject material in the pull mode, the actuating rods face the heaviest loads as tensile forces. As a result, smaller diameter actuating rods can be used than might otherwise be possible.

It should also be noted that the actuating cylinders are preferably spaced apart enough such that they are outboard of the machine to which the ejector bucket is attached. By using two cylinders which are spaced apart in this fashion, the ejector bucket of the preferred embodiment can be mounted closer to the machine. The closer that the bucket is mounted to the machine, the higher loads it can accommodate without tipping of the machine. The absence of a centrally-mounted actuating cylinder also allows the ejector bucket to be more easily used with some of the mounting structures employed on skid-steer and other types of loading machines.

This compact mounting design is further assisted by the preferred orientation of the cylinder fittings. In particular, the actuating cylinders are oriented so that the hose fittings 44, 45 extend sideways, i.e., face inward from the side walls 16 of the bucket frame.

Finally, it should be noted that the preferred configuration of the ejector bucket results in very little lateral or rotational movement of the actuating cylinders during actuation of the cylinders. Excess movement of the cylinder can cause wear and tear on the cylinder casing and mounting brackets, as well as on the hydraulic hoses and hose fittings. In the preferred embodiment of the present invention, the actuating rods move substantially straight line, such that very little lateral or rotational movement of the entire cylinder takes place.

The foregoing constitutes a description of the preferred embodiment of the present invention. Numerous modifications are possible without departing from the spirit and scope of the invention. For example, the overflow guard may be a part of the ejector plate and not the frame. Moreover, while the ejector bucket of the preferred embodiment is designed to be used as an attachment to a skid-steer front loader, the principals of the present invention can be adopted to other types of loader buckets, such as a backhoe bucket. Thus, the scope of the present invention is defined, not in the preceding description, but in the following claims.

I claim:

1. An ejector bucket for loading and ejecting material, comprising:

a bucket frame, the bucket frame including opposing side walls and a bottom wall extending between the side walls;

an ejector plate located within the bucket frame, the ejector plate being movable between a first position where the ejector plate and the bucket frame together form a bucket for holding material and a second position where the ejector plate has pushed substantially all of the material out of the bucket;

an ejector bracket attached to the ejector plate and pivotably connected to the frame, said ejector bracket comprising a collar which is pivotably mounted to the frame, a mounting arm attached to the ejector plate and having an end attached to the collar, and a lever arm having a first end and a second end, the second end of the lever arm being attached to the collar; and an actuating cylinder connected to the bucket frame and to the first end of the lever arm, the actuating cylinder comprising a casing having a cylindrical side wall and opposing end walls, a piston movably disposed within the casing, and an actuating rod having a first end attached to the piston and a second end extending out of the casing through an opening in one of the end walls;

wherein said actuating cylinder is operable in a push mode wherein the actuating rod is pushed out of the casing, and is operable in a pull mode wherein the actuating rod is drawn into the casing; and wherein operation of the actuating cylinder in the pull mode causes the ejector bracket to pivot so as to cause the ejector plate to move from the first position to the second position, and operation of the actuating cylinder in the push mode causes the ejector bracket to pivot so as to cause the ejector plate to move from the second position to the first position.

2. The ejector bucket as claimed in claim 1, wherein the side walls of the bucket frame define a top surface and a bottom surface, and wherein the ejector bracket is pivotably connected to at least one of the side walls at a point below the top surface thereof.

3. The ejector bucket as claimed in claim 2, wherein the bucket frame further comprises an overflow guard extending between the top surfaces of the side walls.

4. The ejector bucket as claimed in claim 1, comprising two of said ejector brackets and two of said actuating cylinders, each of said ejector brackets being pivotably mounted on said bucket frame, and each of said actuating cylinders being attached to one of said ejector brackets.

5. The ejector bucket as claimed in claim 4, further comprising at least one pivot rod mounted on the frame, the ejector plate and the ejector brackets being pivotably attached to the pivot rod.

6. The ejector bucket as claimed in claim 1, wherein the ejector plate comprises first and second plate members and a hinge which joins the first and second plate members together.

7. The ejector bucket as claimed in claim 1, wherein the casing of the actuating cylinder is attached to the bucket frame, and the second end of the actuating rod is attached to the first end of the lever arm of the ejector bracket.

8. The ejector bucket as claimed in claim 1, wherein said actuating cylinder comprises a plurality of fittings attached to the casing through which hydraulic fluid is supplied to the actuating cylinder, wherein the fittings are formed on a portion of said cylindrical side wall which generally faces inward from one of the side walls of the bucket frame.

9. The ejector bucket as claimed in claim 1, comprising two of said actuating cylinders connected to the bucket frame and the ejector plate.

10. An ejector bucket for loading and ejecting material, comprising:

a bucket frame, the bucket frame including opposing side walls and a bottom wall extending between the side walls;

an ejector plate located within the bucket frame, the ejector plate having first and second plate members and a hinge which joins the first and second plate members together, the ejector plate being movable between a first position where the ejector plate and the bucket frame together form a bucket for holding material and a second position where the ejector plate has pushed substantially all of the material out of the bucket;

two ejector brackets, each of said ejector brackets having a collar which is pivotably connected to the frame, a mounting arm attached to the collar and to the first plate member, and a lever arm having a first end and a second end, the first end of the lever arm being attached to the collar; and two hydraulic actuating cylinders, each of the actuating cylinders being located adjacent to one of the side walls of the bucket frame, each of the actuating cylinders comprising a casing connected to the bucket frame and having a cylindrical side wall and opposing end walls, a piston movably disposed within the casing, and an actuating rod having a first end attached to the piston and a second end extending out of the casing through an opening in one of the end walls, said second end of the actuating rod being attached to the second end of the lever arm of one of the ejector brackets;

wherein each of said ejector cylinders is operable in a push mode wherein the piston moves so as to push the actuating rod out of the casing, and is operable in a pull mode wherein the piston moves so as to draw the actuating rod into the casing; and wherein operation of the ejector cylinders in the pull mode causes the ejector plate to move from the first position to the second position, and operation of the ejector cylinder in the push mode causes the ejector plate to move from the second position to the first position.

* * * * *